US005338910A

United States Patent [19]

Tsai

[11] Patent Number: 5,338,910

[45] Date of Patent: Aug. 16, 1994

[54] WALL CONTROLLER

[76] Inventor: Powell Tsai, No. 76, Wei Daw II St., Lai Tsuoh Li, Taichung, Taiwan

[21] Appl. No.: 17,271

[22] Filed: Feb. 12, 1993

[51] Int. Cl.[5] ..... H01H 15/02

[52] U.S. Cl. ..... 200/547; 200/292; 200/5 A

[58] Field of Search ..... 200/536, 547, 548, 549, 200/550, 551, 252, 292, 5 R, 5 A

[56] References Cited

U.S. PATENT DOCUMENTS

| | | | |
|---|---|---|---|
| 3,485,966 | 12/1969 | Bailey et al. | 200/550 X |
| 4,395,609 | 7/1983 | Sowash | 200/551 X |
| 5,068,639 | 11/1991 | Swanson et al. | 200/252 X |
| 5,191,971 | 3/1993 | Hakkarainen et al. | 200/550 |

FOREIGN PATENT DOCUMENTS

| | | | |
|---|---|---|---|
| 22502 | 1/1991 | Japan | 200/536 |
| 2041656 | 9/1980 | United Kingdom | 200/551 |

*Primary Examiner*—Glenn J. Bannett

[57] ABSTRACT

A wall controller for controlling the speed of rotation of a ceiling fan and the intensity of light of a lighting fixture, which includes a junction box covered with a slotted mounting plate to hold a control circuit assembly, a cover plate connected to the mounting plate to hold a switch control slide assembly therebetween, the control circuit assembly is consisted of two switches moved by two control slides of the switch control slide assembly to control the operation of the lighting fixture and the ceiling fan respectively.

1 Claim, 4 Drawing Sheets

WALL CONTROLLER

BACKGROUND OF THE INVENTION

The present invention relates to a wall controller fastened to the wall for controlling the speed of rotation of a ceiling fan and the intensity of light of a lighting fixture.

A variety of ceiling fans with lighting fixtures are known and widely accepted. Because the power required is about 120 Watts for the ceiling fan and about 500 Watts for the lighting fixture, two separate control circuits are needed for controlling the speed of rotation of the ceiling fan and the intensity of light of the lighting fixture. Since the control device of a ceiling fan with a lighting fixture comprises two separate control circuits, much installation space is required, and the manufacturing cost of the control device is high.

SUMMARY OF THE INVENTION

An object of the present invention is to provide a wall controller which controls the speed of rotation of a ceiling fan and the intensity of light of a lighting fixture through a unitary control circuit assembly. Another object of the present invention is to provide a wall controller for controlling the operation of a ceiling fan with a lighting fixture which requires less installation space. Still another object of the present invention is to provide a wall controller for controlling the operation of a ceiling fan with a lighting fixture which is inexpensive to manufacture. Still another object of the present invention is to provide a wall controller for controlling the operation of a ceiling fan with a lighting fixture which is fastened inside a compact junction box embedded in the wall and covered with a cover plate for convenient control without causing damage to the scenery of a room.

DETAILED DESCRIPTION OF THE PREFERRED EMBODIMENT

Figure 1:
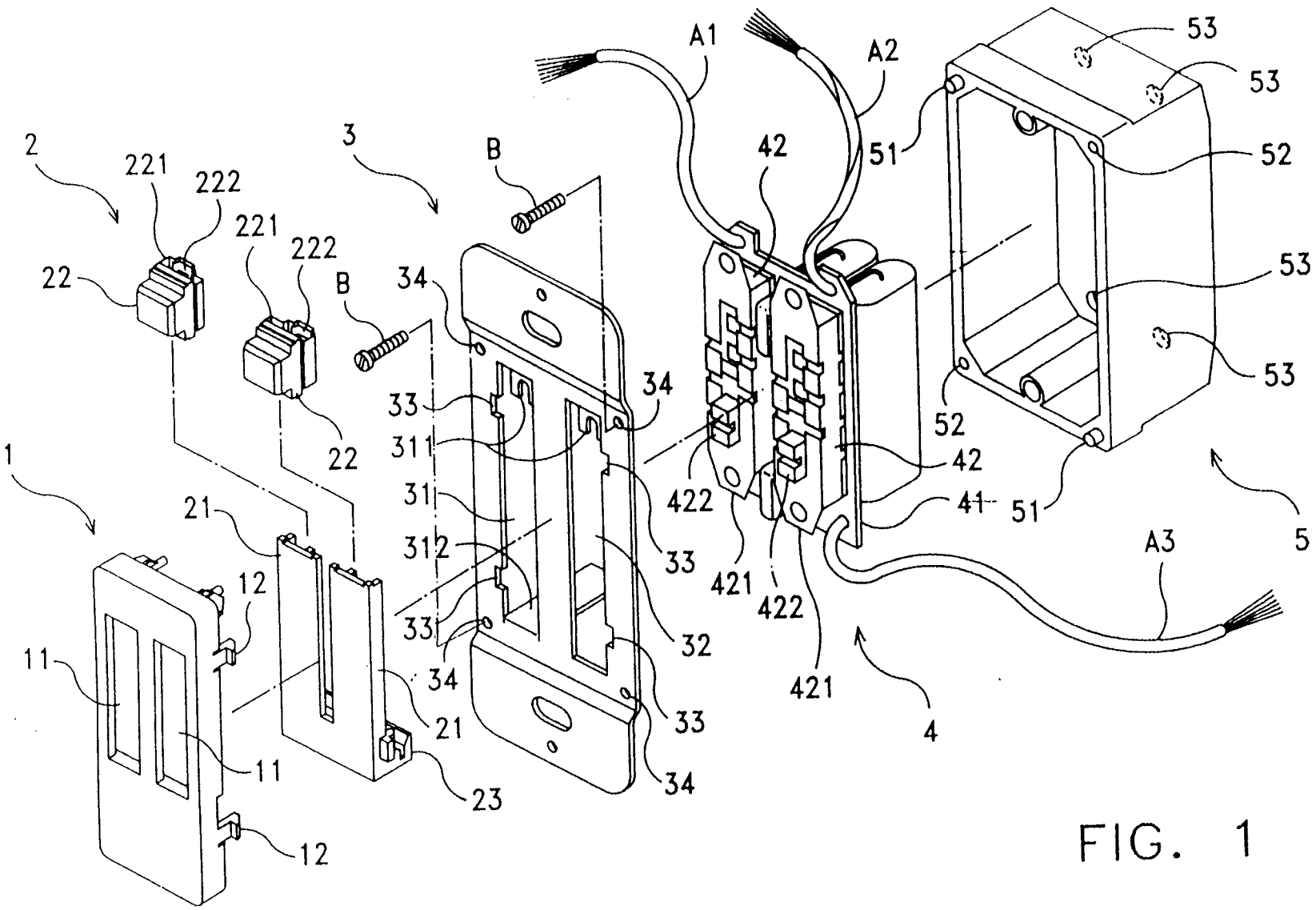
FIG. 1 is an exploded view of a wall controller according to the present invention.

Referring to FIG. 1, a wall controller in accordance with the present invention is generally comprised of a cover plate 1, a switch control slide assembly 2, a mounting plate 3, a control circuit assembly 4, and a junction box 5.

The cover plate 1 is made in a rectangular shape having two slide slots 11, and pairs of back hooks 12. The switch control slide assembly 2 comprises two vertical parallel rails 21 two control slides 22 respectively mounted and slid on the rails 21 and extended out of the cover plate 1 through the slide slots 11, and an angle strip 23 horizontally connected to the vertical parallel rails 21 at the bottom. The control slide 22 comprises a resilient mounting portion 221 for inserting the rail 21, and a recessed hole 222. The mounting plate 3 is made in a rectangular shape, comprising two switch slots 31,32 corresponding to the slide slots 11 on the cover plate 1, two downward hooks 311 respectively projected from the switch slots 31,32 at the top, a horizontal support 312 extended backwards from one switch slot 31 at the bottom, pairs of retaining notches 33 at locations corresponding to the back hooks 12 on the cover plate 1, and round holes 34 at four corners of the mounting plate 3 around the switch slots 31,32. The control circuit assembly 4 comprises a circuit board 41 and two switching devices 42. The switching devices 42 are mounted on the circuit board 41 at locations corresponding to the switch slots 31,32 on the mounting plate 3, each of which comprising a switch 422 and a face panel 421. The circuit board 41 comprises a lighting fixture neutral wire A1 and a hot wire A2 at the top, and a ceiling fan neutral wire A3 at the bottom. The junction box 5 is made in the shape of a rectangular case having two pins 51 at two diagonal front corners and two round holes 52 at the other two diagonal front corners, a plurality of round holes 53 on the back.

Figure 2:
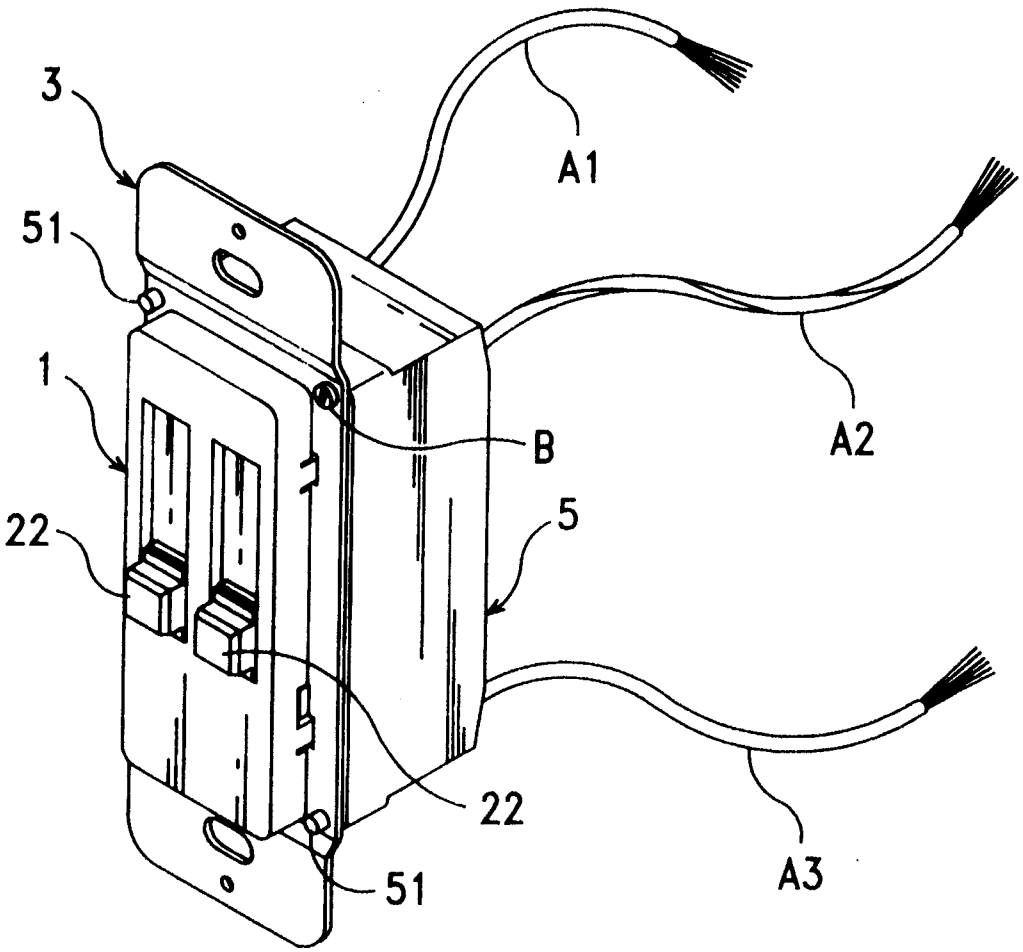
FIG. 2 is an elevational view.
Figure 3B:
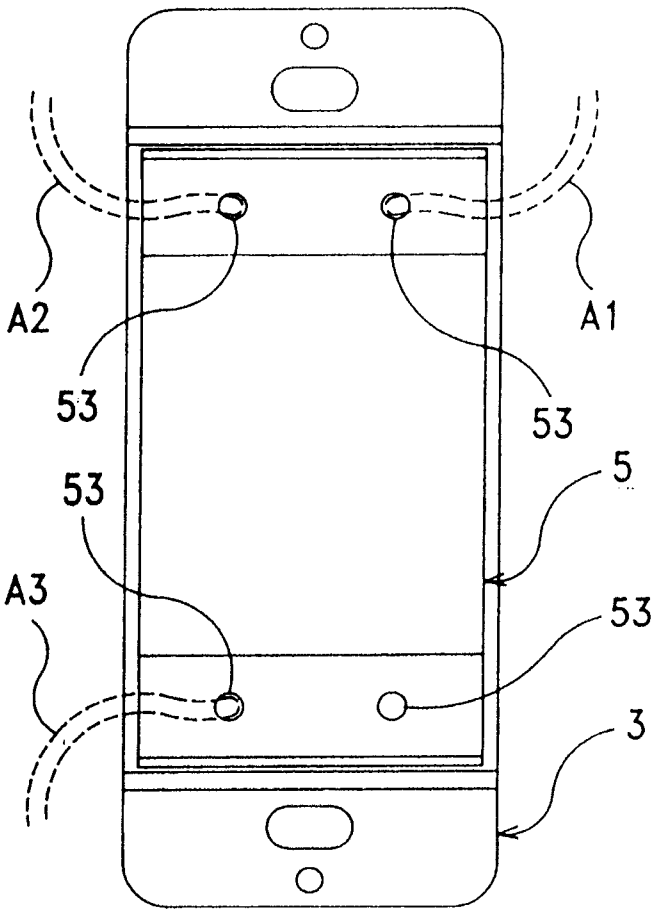
FIGS. 3A–3B are respectively side and back views of the present invention.
Figure 3A:
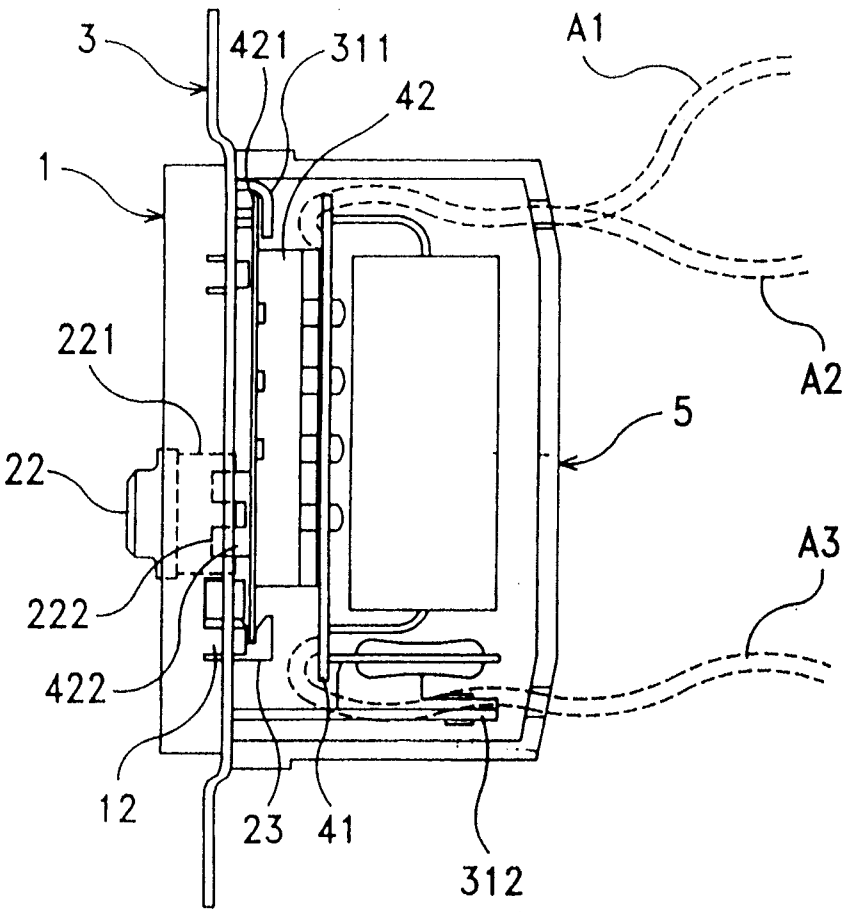

Referring to FIGS. 2, 3A and 3B, and FIG. 1 again, the back hooks 12 of the cover plate 1 are respectively hooked on the retaining notches 33 to hold the switch control slide assembly 2 therebetween, and then the control circuit assembly 4 is placed on the horizontal support 312, with face panels 421 of the two switching devices 42 respectively hooked between the downward hooks 311 and the angle strip 23, and with the switch 422 of each switching device 42 respectively engaged into the recessed hole 222 on either control slide 22. Therefore, sliding either control slide 22 causes movement of the corresponding switch 422. The pins 51 on the junction box 5 are respectively inserted in the corresponding round holes 34 on the mounting plate 3 for permitting the control circuit assembly 4 to be received inside the junction box 5. Before setting the control circuit assembly 4 in the junction box 5, the lighting fixture neutral wire A1, the hot wire A2 and the ceiling fan neutral wire A3 are respectively inserted through corresponding round holes 53 on the junction box 5. Then, threading screws B through the other two round holes 34 on the mounting plate 3 into the corresponding round holes 52 on the junction box 5 to fix the mounting plate 3 to the junction box 5. FIG. 2 illustrates the wall controller assembled.

Figure 4:
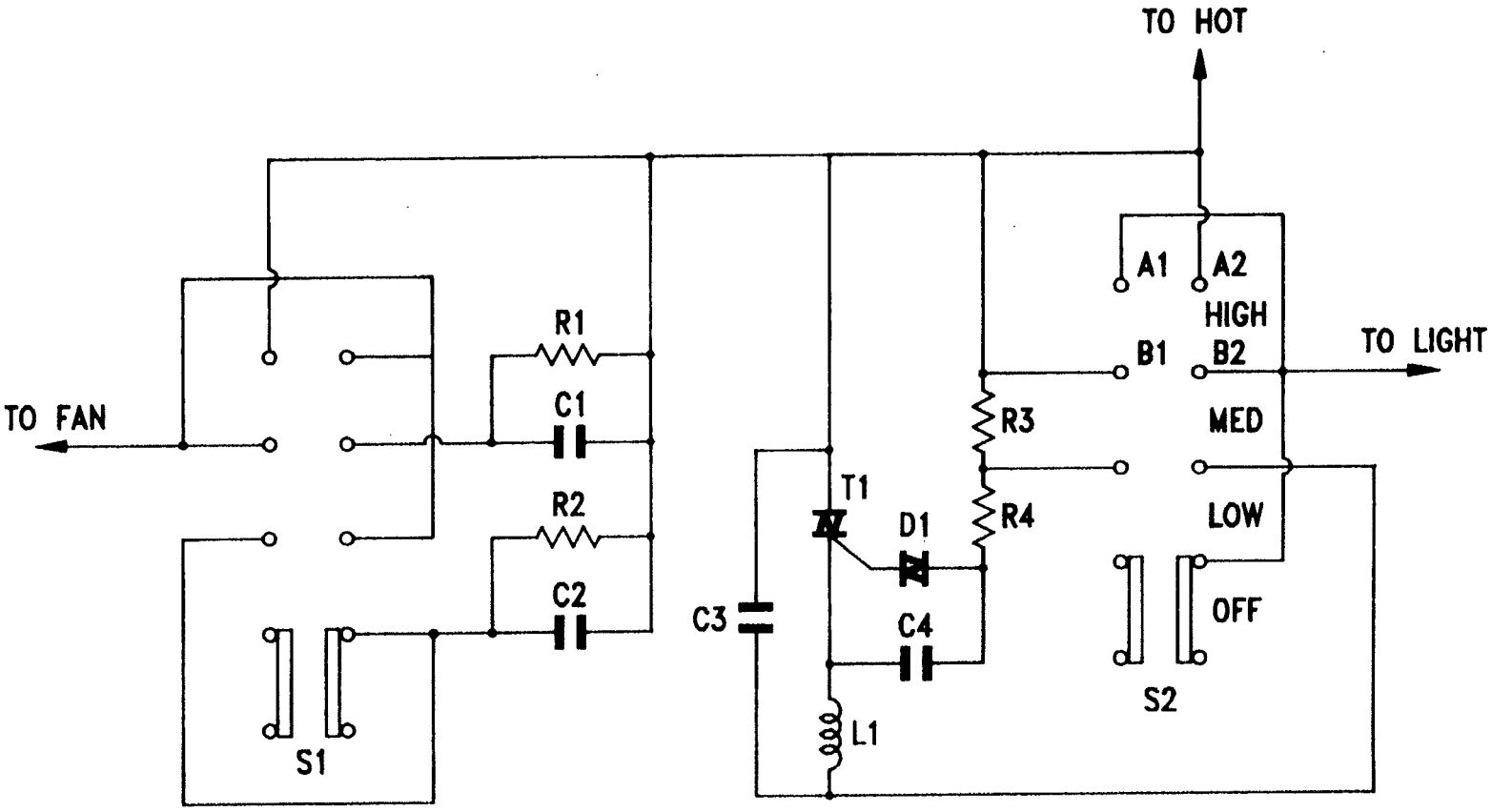
FIG. 4 is a control circuit diagram of the present invention.

Referring to FIG. 4, the control circuit for controlling the lighting fixture is generally comprised or a triac T1. For High/Medium/Low three-step lighting intensity control, the current which passes through the triac T1 should be relatively regulated through three different steps. Because the power required is about 500 Watts for the lighting fixture and about 120 Watts for the ceiling fan, high power current must be stopped from passing through the triac T1. As the switch S2 (namely, the switching device 42 in FIG. 1) is moved to High, the contacts A1, A2 are respectively connected to the contacts B1,B2, and power supply is directly connected to the lighting fixture without passing through the triac T1. Because contacts A2,B2 and contacts A1,B1 are connected in parallel, electric current to the lighting fixture is equally shared, and the current specification of the switch (namely, the triac T1) can be relatively reduced. This arrangement prolongs the service life of the triac T1, eliminates the interference of harmonic waves, and allows the ceiling fan control circuit and the lighting fixture control circuit to be incorporated into a circuit board in reducing the installation space.

What is claimed is:

1. A wall controller comprising:

a cover plate made in a rectangular shape having two slide slots, and pairs of back hooks;

a switch control slide assembly, said switch control slide assembly comprising two vertical parallel rails, two control slides respectively mounted and slid on said rails and extended out of said cover plate through said slide slots, and angle strip horizontally connected to said vertical parallel rails at bottom end thereof, each control slide having a resilient mounting portion for inserting said rail, and a recessed hole;

a mounting plate connected to said cover plate to hold said switch control slide assembly therebetween, said mounting plate comprising two switch slots corresponding to said slide slots on said cover plate, two downward hooks respectively projected from said switch slots at top end thereof, a horizontal support extends backward from said switch slot at bottom end thereof, pairs of retaining notches, on which said back hooks of said cover plate are hooked respectively, and round holes at four corners of said mounting plate around said switch slots;

a control circuit assembly supported on said horizontal support of said mounting plate, said control circuit assembly comprising two switching devices mounted on a circuit board by two face panels, said face panels being respectively inserted in said switch slots on said mounting plate and hooked between said downward hooks of said mounting plate and said angle strip of said switch control slide assembly, each switching device being respectively engaged into said recessed hole on either said control slide and moved by the respective control slide to control the speed of rotation of a ceiling fan or the intensity of light of a lighting fixture, said circuit board comprising a lighting fixture neutral wire, a hot wire, and a ceiling fan neutral wire; and a junction box being made in the shape of a rectangular box connected to said mounting plate to hold said control circuit assembly inside said junction box, said junction box comprising two pins at two diagonal front corners thereof fitted into two corresponding round holes on said mounting plate, two round holes at the other two diagonal front corners thereof respectively connected to the other two round holes on said mounting plate by screws, a plurality of wire holes on the back thereof, through which said lighting fixture neutral wire, said hot wire and said ceiling fan neutral wire are respectively inserted.

* * * * *